US008469537B2

(12) United States Patent
Carle, Jr.

(10) Patent No.: US 8,469,537 B2
(45) Date of Patent: Jun. 25, 2013

(54) SHADE FOR A RECESSED LIGHT FIXTURE

(75) Inventor: William A. Carle, Jr., St. Joe, MI (US)

(73) Assignee: Lake Shore Studios, Inc., Saint Joseph, MI (US)

( * ) Notice: Subject to any disclaimer, the term of this patent is extended or adjusted under 35 U.S.C. 154(b) by 183 days.

(21) Appl. No.: 13/010,171

(22) Filed: Jan. 20, 2011

(65) Prior Publication Data

US 2011/0170300 A1 Jul. 14, 2011

Related U.S. Application Data

(63) Continuation-in-part of application No. 12/137,790, filed on Jun. 12, 2008, now Pat. No. 7,874,706.

(51) Int. Cl.
*F21S 8/00* (2006.01)

(52) U.S. Cl.
USPC ..... 362/147; 362/359

(58) Field of Classification Search
USPC ..... 362/147, 364–366, 356–357, 359
See application file for complete search history.

(56) References Cited

U.S. PATENT DOCUMENTS

| | | | | |
|---|---|---|---|---|
| 5,465,199 | A | 11/1995 | Bray et al. | |
| 5,738,437 | A | 4/1998 | Ilagan | |
| D417,746 | S | 12/1999 | Pahl | |
| 6,497,501 | B1 | 12/2002 | Harder | |
| 6,832,846 | B2 | 12/2004 | Lagonegro | |
| 7,121,684 | B2 | 10/2006 | Barozzini et al. | |
| 7,198,391 | B2 | 4/2007 | Rutchik | |
| 7,217,007 | B2 | 5/2007 | Choi | |
| 2006/0256566 | A1 | 11/2006 | Beghelli | |
| 2007/0236946 | A1 * | 10/2007 | Petrakis et al. | 362/374 |

* cited by examiner

*Primary Examiner* — Donald Raleigh
(74) *Attorney, Agent, or Firm* — Barnes & Thornburg LLP

(57) ABSTRACT

A shade for a recessed light fixture and a method of making same. In some embodiments the shade may include a fastener that extends includes the can of the recessed light fixture through its open end. For example, the fastener may extend from the top end of the shade into the can and attach to an annular wall of the can.

13 Claims, 6 Drawing Sheets

SHADE FOR A RECESSED LIGHT FIXTURE

RELATED APPLICATIONS

This application is a continuation-in-part of U.S. application Ser. No. 12/137,790, filed Jun. 12, 2008, which is hereby incorporated by reference in its entirety.

TECHNICAL FIELD

This invention generally relates to recessed light fixtures; in particular, the invention relates to a shade for a recessed light fixture.

BACKGROUND

Recessed light fixtures are in wide-spread use. Typically, they are installed in a ceiling and direct light downward to the floor. Although recessed lights provide more indirect lighting than other types of light fixtures, the light source is often still readily visible from many different positions in the room. This glare can be unsightly and may cause discomfort to persons in the room.

SUMMARY

According to one aspect, the invention provides a shade for a recessed light fixture. In some embodiments, the shade includes a shade body having a top end and a bottom end. A fastener may be provided for coupling together the shade body with a recessed light fixture that includes a can with a base and an open end. In some cases, the fastener extends from the top end of the shade body through the open end of the can. In some embodiments, the fastener includes a fastening portion coupled with an annular wall of the can between the open end and the base. For example, the fastening portion could be a hook dimensioned to be received by a hole defined in the annular wall of the can.

Embodiments are contemplated in which the shade body includes an exterior wall extending between the top end and the bottom end and a flange that extends inwardly from the exterior wall. For example, the fastener may include a fastening portion coupled with the inwardly extending flange. In some cases, the fastening portion is a hook dimensioned to be received by a hole defined in the inwardly extending flange. In one embodiment, the flange may be an annular ring. For example, the annular ring may define an opening through which the fastener may extend.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
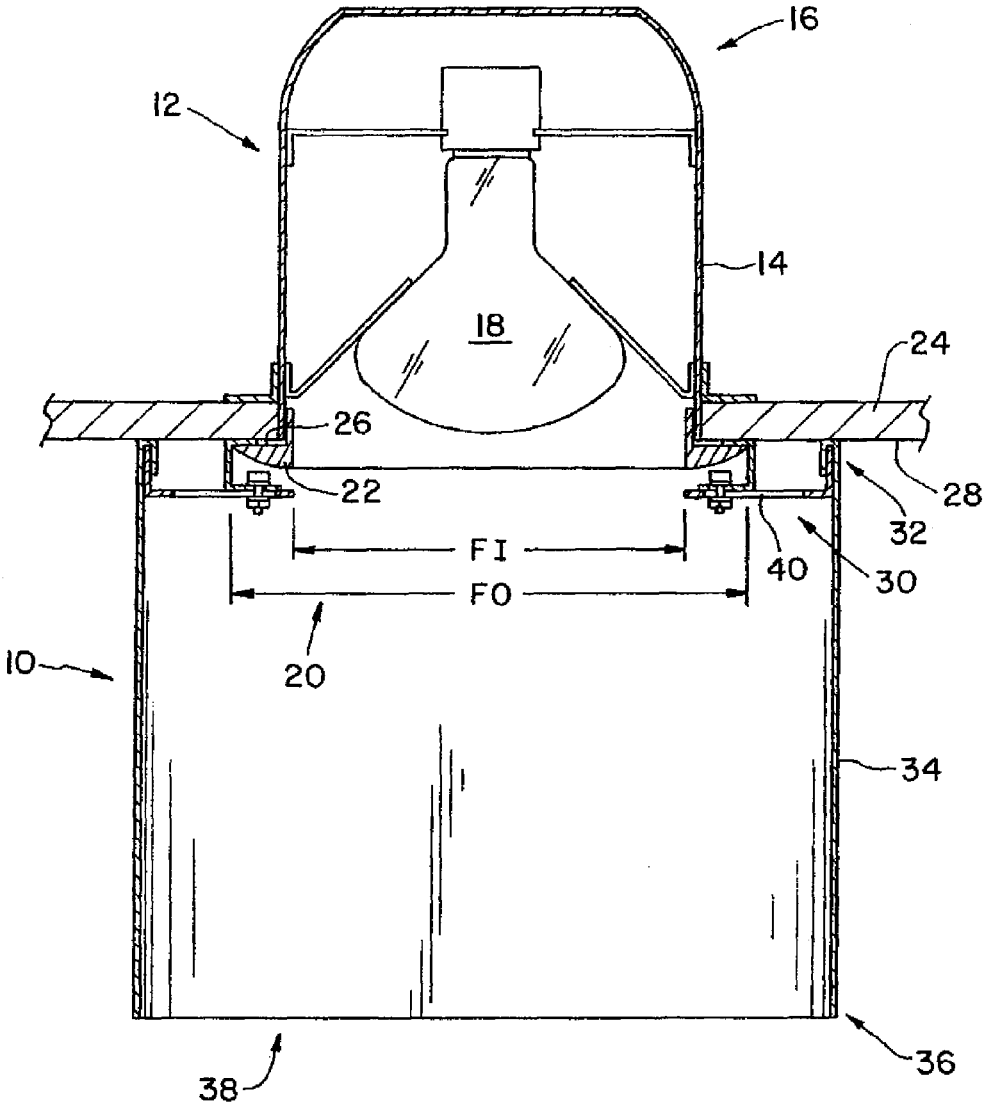
FIG. 1 is a side cross-sectional view of an example shade flush mounted to a recessed light fixture, according to an embodiment of the invention.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

In the illustrative embodiment shown in FIG. 1, a shade 10 is flush mounted to a recessed light fixture 12. The terms "flush mount" and "flush mounted" mean the shade is coupled to a recessed light fixture such that at least a portion of the top end of the shade is immediately adjacent the outer surface of the ceiling in which the recessed light fixture is installed, without any gap (or an insubstantial gap) therebetween. The recessed light fixture 12 is shown for example purposes only, but could be any type, style, or size of recessed light fixture, which are also commonly known as "can lights." The recessed light fixture 12 is a conventional light fixture and does not form any part of the invention. The terms "couple" and "coupled" are broadly intended to encompass both direct and indirect coupling.

In this example, the recessed light fixture 12 includes a can portion 14 with a base 16 that typically houses a light source 18. The can portion 14 includes an open end 20 through which light radiates. An annular flange 22 extends from the open end 20 of the can portion 14. The flange 22 has an inner diameter ("FI") and an outer ("FO"). As shown, the can portion 14 extends into a hole in a ceiling 24 to project light downward. Without the shade 10 installed, an upper surface 26 of the flange 22 would be immediately adjacent to an outer surface 28 of the ceiling 24. In this example, however, an attachment mechanism 30 couples the shade 10 to the recessed light fixture 12 so the shade 10 is suspended above the floor. In this example, with a flush mounted arrangement, the top end 32 of the shade 10 is immediately adjacent the outer surface 28 of the ceiling 24 without a gap (or an insubstantial gap) therebetween.

Figure 2:
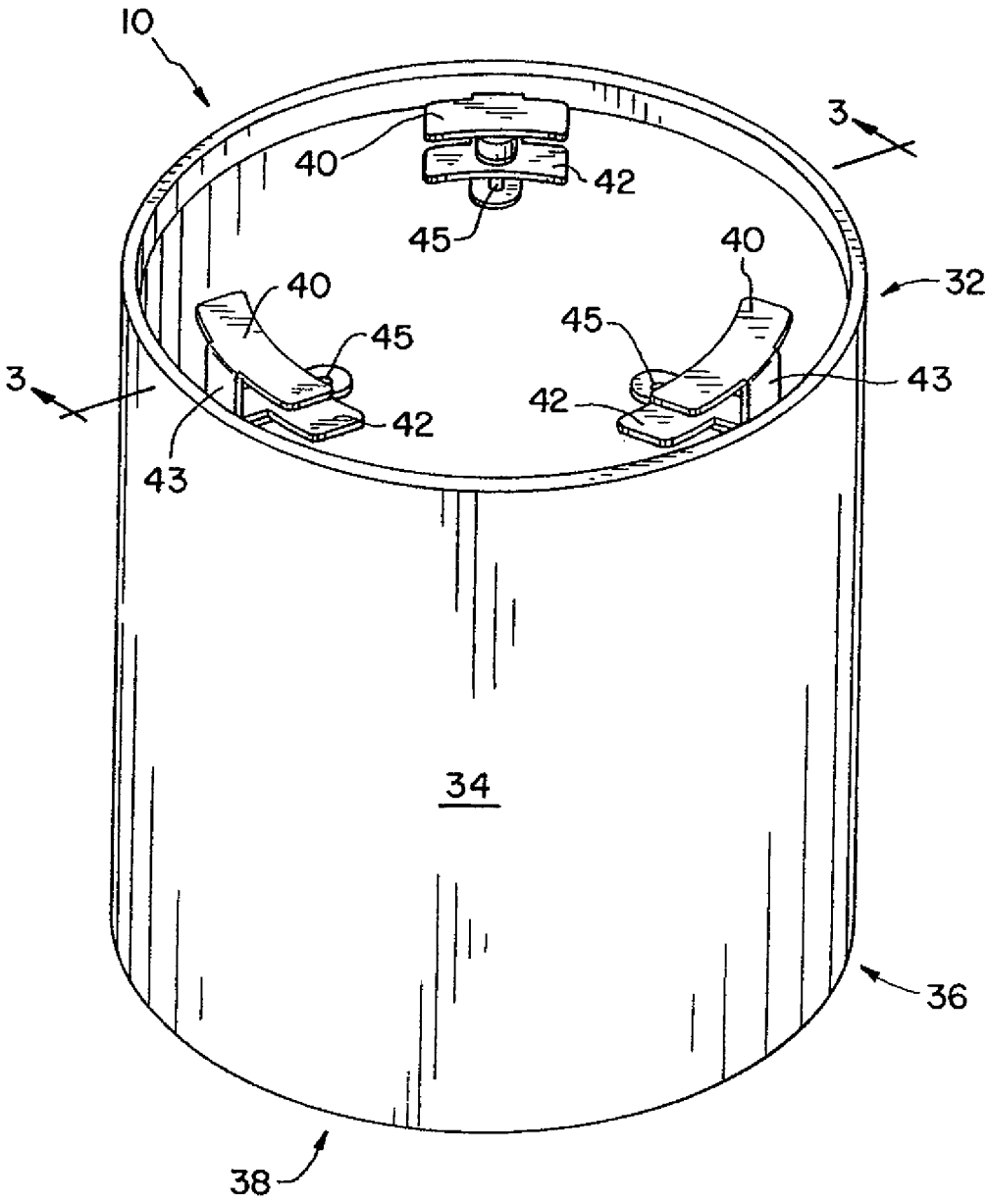
FIG. 2 is a perspective view of the example shade shown in FIG. 1.
Figure 4:
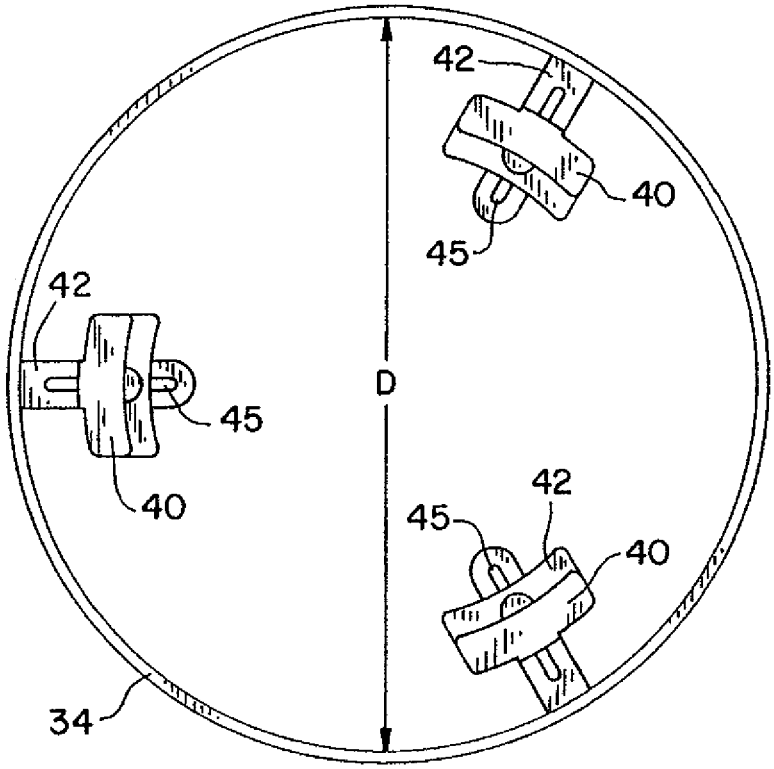
FIG. 4 is a top view of the example shade shown in FIG. 1.

FIG. 2 is a perspective view of the example shade 10 shown in FIG. 1. The shade 10 has a shade body 34 with a top end 32 and a bottom end 36. In some cases, such as the embodiment shown, the shade 10 may include a passageway 38 for light to pass therethrough. Embodiments are contemplated in which the shade 10 may not include a passageway 38, such as embodiments in which a portion of the shade is transparent or translucent. Although the shade body 34 has a cylindrical shape in this example, it should be appreciated that the shade body 34 could have an infinite number of shapes, sizes, and styles. The shade body 34 could be formed from a variety of materials for desired optical effects, including materials that are transparent, translucent, opaque, or a combination thereof. The materials for the shade body 34 could include, but are not limited to, fabric, leather, glass, plastic, paper, metal, and/or wood. As shown, the shade body 34 has an inner diameter ("D"), as best seen in FIG. 4. Typically the inner diameter D is greater than the outer diameter FO of the flange 22.

In the example shown, the top end 32 of the shade 10 includes an attachment mechanism 30. In the embodiment shown, the attachment mechanism 30 includes arms 40 that are configured to create an interference fit between the flange 22 and the ceiling 24. As shown, the arms 40 are suspended above arm mounting portions 42 via a linking member 43. In some cases, the arms 40 could be movable along the arm mounting portions 42 to adjust to various sized of recessed light fixtures. For example, in the embodiment shown, the arm mounting portions 42 include slots 45 along which the arms 40 are movable. Embodiments are contemplated in which the arms 40 could be adjusted by pivoting about arm mounting portions 42. The arm mounting portions 42 could include a base 47 (see FIG. 3) coupled with the shade body 34. In some embodiments, the arm mounting portions 42 could be unitary with the shade body 34.

Figure 3:
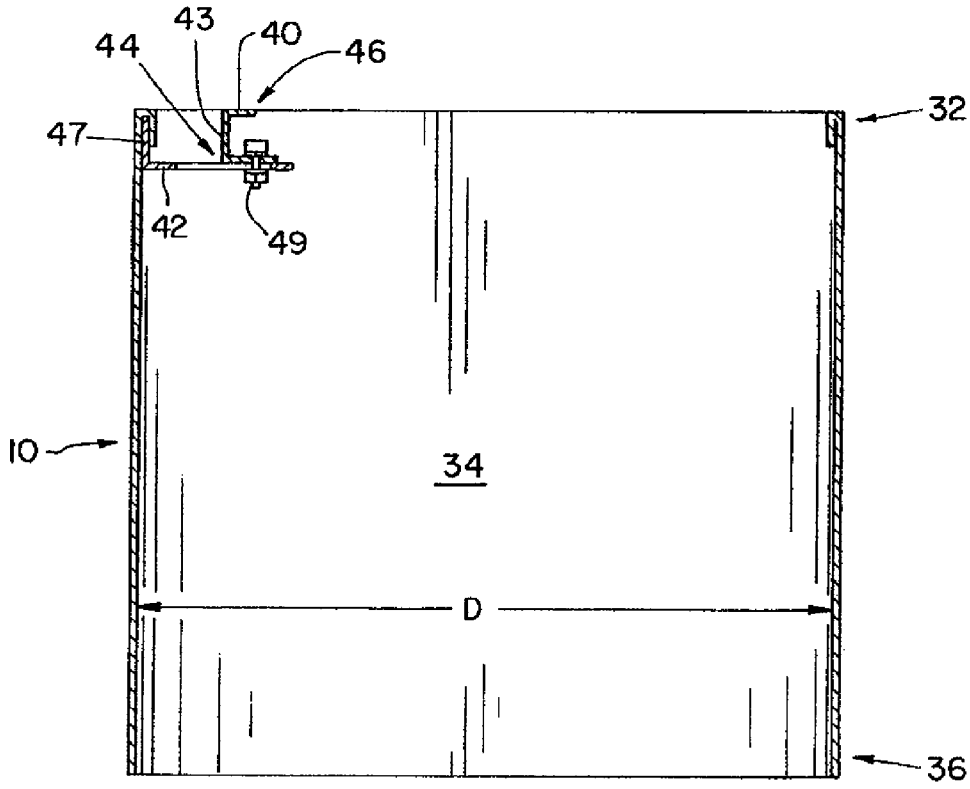
FIG. 3 is a side cross-sectional view of the example shade shown in FIG. 1 along line 3-3.

FIG. 3 is a side cross-sectional view of the example shade 10 shown in FIG. 1. In this example, a proximal end 44 of the arm 40 is coupled with the arm mounting portion 42 with fasteners 49, while the distal end 46 of the arm 40 extends into the passageway 38 of the shade body 34. As shown, the distal end 46 extends from the arm mounting portion 42. This allows the distal end 46 to engage the flange 22 of the light fixture 12.

FIG. 4 is a top view of the example shade 10 shown in FIG. 1. In this example, each of the arms 40 is capable of moving along the slots 45 in the arm mounting portions 42. As shown, the arms 40 are movable in a substantially horizontal plane. This allows adjustment of the distal end 46 of the arms 40 to be coupled with the recessed light fixture 12. The arms 40 may be interposed between the upper surface 26 of the flange 22 and the outer surface 28 of the ceiling 24. In the example shown, this would be caused movement of one or more of the arms 40 to position the distal end 46 between the outer diameter FO and the inner diameter FI of the flange 22. It should be appreciated that other mechanisms for creating an interference fit between the top end 32 of the shade 10 and the recessed light fixture 12 could be provided. For example, the attachment mechanism 30 could have a portion that rotates between an extracted position that engages the flange and a retracted position to release the shade 10. In the embodiment shown, the arms 40 are circumferentially-arranged approximately 120 degrees apart; however, it should be appreciated that other arrangements of the attachment mechanism 30 could be provided. For example, embodiments are contemplated in which less than three arms 40 could be provided; likewise, more than three arms could be provided in the attachment mechanism 30.

Figure 5:
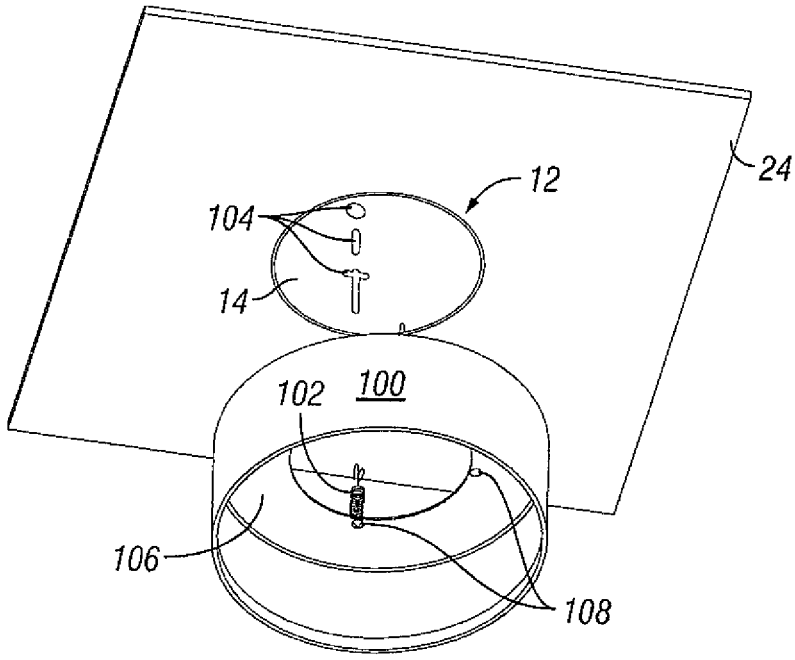
FIG. 5 is an exploded view of an example shade assembly with a recessed light fixture according to another embodiment of the invention.

FIG. 5 is an exploded view showing an example shade assembly 100 according to another embodiment to be coupled with a recessed light fixture 12. In the example shown, the flange 22, also known as trim, of the recessed light fixture 12 has been removed. As shown, the can portion 14 includes one or more interior holes 104 through which a fastener 102 may couple the shade assembly 100 with the recessed light fixture 12. In this example, the shade assembly 100 includes a top end with an inwardly extending flange 106 through which a plurality of holes 108 are defined. In the example shown, the fastener 102 includes a top end with an upper hook 110 that may be received by a hole 104 in the recessed light fixture 12 and a lower end with a lower hook 112 that may be received by a hole 108 in the flange 106 of the shade assembly 100. In this example, the top end of the shade assembly 100 includes an opening 114 through which the fastener extends to couple with the recessed light fixture 12.

Figure 6:
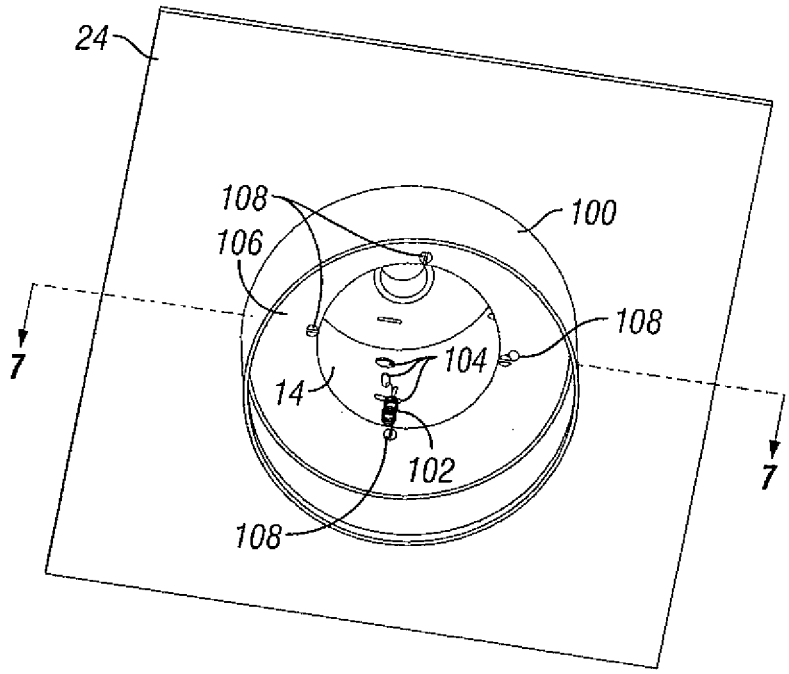
FIG. 6 is a perspective view of the example shade assembly shown in FIG. 5 installed on a recessed light fixture.
Figure 7:
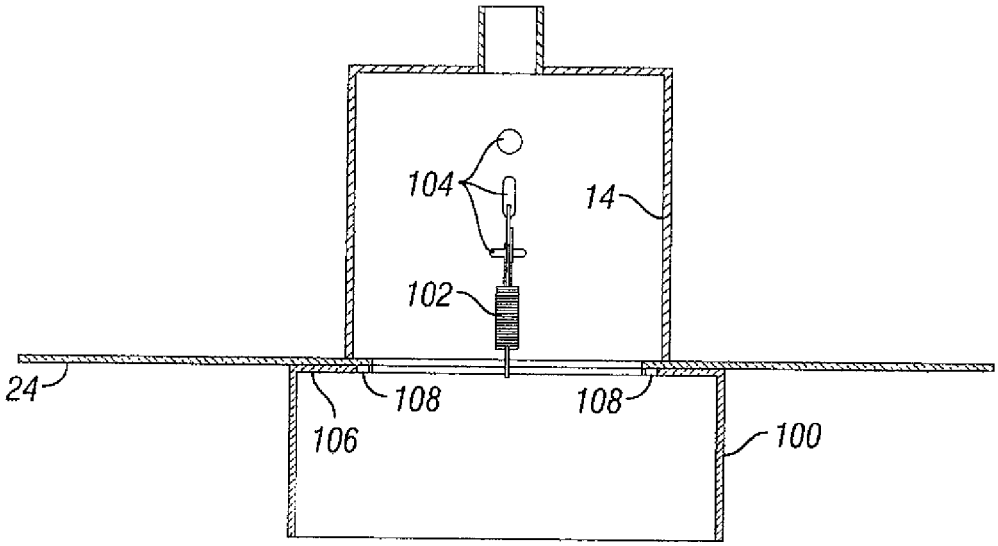
FIG. 7 is a side cross-sectional view of the example shade assembly shown in FIG. 6 along line 7-7.

FIG. 6 shows the example shade 100 installed on the recessed light fixture. In this example, two or more fasteners 102 couple the shade assembly 100 to the recessed light fixture 12 using the hooks 110, 112 and hooks 104, 108. As shown in FIGS. 6 and 7, the shade assembly 100 may be flush mounted with the recessed light fixture 12.

Figure 8:
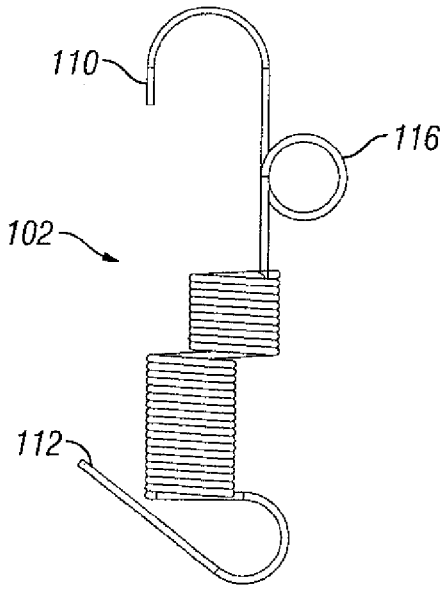
FIG. 8 is a left side view of an example fastener that could be used to attach the shade assembly to a recessed light fixture.

FIG. 8 shows an example fastener 102 that may be used to couple the shade assembly 100 with the recessed light fixture 12. As shown, the fastener 102 is a spring with an upper hook 110 and a lower hook 112. In this example, the fastener includes a ring 116 that is dimensioned to receive a tool for controlling movement of the fastener 12 during installation.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A shade for a recessed light fixture, the shade comprising:

a shade body having a top end and a bottom end;

a fastener coupling together the shade body with a recessed light fixture having a can with a base and an open end;

wherein the fastener extends from the top end of the shade body through the open end of the can;

wherein the fastener includes a first fastening portion coupled with a wall of the can between the open end and the base;

wherein the shade body includes an exterior wall extending between the top end and the bottom end and a flange that extends inwardly from the exterior wall, wherein the fastener includes a second fastening portion coupled with the inwardly extending flange; and wherein the inwardly extending flange is an annular ring defining a plurality of holes dimensioned to receive the second fastening portion of the fastener.

2. The shade as recited in claim 1, wherein the first fastening portion is a hook dimensioned to be received by a hole defined in the annular wall of the can.

3. The shade as recited in claim 1, wherein the second fastening portion is a hook dimensioned to be received by at least one of the plurality of holes defined in the inwardly extending flange.

4. The shade as recited in claim 1, wherein the annular ring defines an opening, wherein the fastener extends through the opening.

5. The shade as recited in claim 1, wherein the fastener is a spring with a first hook coupled with an annular wall of the can between the base and open end, wherein the spring includes a second hook coupled with the inwardly extending flange, wherein the spring extends from the top end of the shade body through the open end of the can.

6. A shade for a recessed light fixture, the shade comprising:

a shade body having a top end with an opening and a bottom end, wherein the shade body includes an exterior wall extending between the top end and the bottom end, wherein the shade body includes a flange extending inwardly from the exterior wall;

a fastener coupling together the shade body with a recessed light fixture having a can with a base and an open end;

wherein the fastener extends through the opening in the top end of the shade body;

wherein the fastener includes a first fastening portion coupled with a wall of the recessed light fixture and a second fastening portion coupled with the inwardly extending flange; and wherein the inwardly extending flange has an annular shape.

7. The shade as recited in claim 6, wherein the fastener extends into the can through the open end.

8. The shade as recited in claim 6, wherein the first fastening portion is a first hook dimensioned to be received by a hole defined in the flange.

9. The shade as recited in claim 8, wherein the second fastening portion is a second hook dimensioned to be received by a hole defined in the wall of the can.

10. A shade for a recessed light fixture, the shade comprising:

a shade body having a top end with an opening and a bottom end, wherein the shade body includes an exterior wall extending between the top end and the bottom end, wherein the shade body includes a flange extending inwardly from the exterior wall;

a fastener coupling together the shade body with a recessed light fixture having a can with a base and an open end;

wherein the fastener includes a first fastening portion coupled with the can between the base and the open end;

wherein the fastener includes a second fastening portion coupled with the inwardly extending flange;

wherein the fastener extends through the opening in the top end of the shade body; and wherein the flange is an annular ring extending inwardly from the top end of the shade body.

11. The shade as recited in claim 10, wherein the opening in the top end of the shade body is substantially concentric with the open end of the can.

12. The shade as recited in claim 10, wherein flange is adjacent the open end of the shade body.

13. The shade as recited in claim 10, wherein the first fastening portion is a first hook and the second fastening portion is a second hook.

* * * * *